US006668381B2

(12) United States Patent
Tarrell

(10) Patent No.: US 6,668,381 B2
(45) Date of Patent: Dec. 30, 2003

(54) THREE DIMENSIONAL CAMOUFLAGE GARMENT

(75) Inventor: Ev Tarrell, Gurley, NC (US)

(73) Assignee: Cabela's Inc., Sidney, NE (US)

( * ) Notice: Subject to any disclaimer, the term of this patent is extended or adjusted under 35 U.S.C. 154(b) by 2 days.

(21) Appl. No.: 10/107,227

(22) Filed: Mar. 26, 2002

(65) Prior Publication Data

US 2002/0142112 A1 Oct. 3, 2002

Related U.S. Application Data

(60) Provisional application No. 60/279,141, filed on Mar. 27, 2001.

(51) Int. Cl.[7] ..... A41D 1/06
(52) U.S. Cl. ..... 2/69
(58) Field of Search ..... 2/69, 79, 85, 108, 2/93, 94, 900, 227, 228, 81, 82, 9.5, 244, 246; 428/919, 15, 17

(56) References Cited

U.S. PATENT DOCUMENTS 4,106,124 A * 8/1978 Green ..... 428/919
4,656,065 A 4/1987 Yacovella
4,931,320 A * 6/1990 Leonard ..... 428/17
5,274,848 A * 1/1994 Shamblin ..... 2/69
5,347,659 A * 9/1994 Tibljas ..... 428/919 X
5,445,863 A 8/1995 Slagle et al.
5,652,963 A * 8/1997 Davison ..... 2/244 X
5,695,835 A * 12/1997 Weber et al. ..... 428/17
5,773,101 A 6/1998 Sanders
6,499,141 B1 * 12/2002 Egnew ..... 2/69

* cited by examiner

*Primary Examiner*—Gloria M. Hale
(74) *Attorney, Agent, or Firm*—Bachman & LaPointe, P.C.

(57) ABSTRACT

The present invention relates to a camouflage garment which utilizes multiple heights of three dimensional materials in strategic panels or points to provide a user with the full benefit of an all-inclusive three-dimensional camouflage fabric garment while still allowing a user friendly or low hindrance design that allows the user quietness, stealth and the like.

16 Claims, 3 Drawing Sheets

THREE DIMENSIONAL CAMOUFLAGE GARMENT

CROSS REFERENCE TO RELATED APPLICATION

The present application claims the benefit of U.S. Provisional Patent Application No. 60/279,141, filed Mar. 27, 2001, entitled "Three Dimensional Camouflage Garment".

BACKGROUND OF THE INVENTION

The present invention generally relates to a three dimensional camouflage garment to be worn by hunters and the like and, in particular, to a three dimensional garment formed by two different three dimensional materials.

Three dimensional fabrics are very popular in the construction of camouflage hunting garments. Three dimensional fabrics are generally defined in the hunting industry as fabrics that have been altered in a variety of manners to create more depth than traditional flat fabrics used in hunting clothing. Examples of three dimensional fabrics are Milliken's INTRIGUE fabric, SHADOWTEX fabric, and GHILLIE SUIT fabric. Many types of three dimensional fabrics exist today. Common techniques used to alter a flat fabric into a three dimensional fabric almost always involves either fraying, rippling, or permanently gathering the flat fabric. Alternatively, additional pieces of fabric may be attached to a base fabric to give the resulting product a thickness dimension above what a traditional woven or knit fabric would give. The resulting three-dimensional appearance is considered as having different light reflectance property when viewed in the field, thus creating a better camouflage effect for the user while hunting.

Three dimensional fabrics, while popular for their camouflaging effect, also promote problems for the user. Hunting activities, both firearm and archery forms alike, involve the use of many tools that hang around the neck of the user and also call for stealth and quietness as the hunter prepares for a shot or uses his tools. Altered flat fabrics or three-dimensional fabrics with their frayed edges, gathered stitches, and extra attached fabrics often create a hindrance while hunting. Shooting bows, using binoculars, shouldering guns, reaching smoothly for an attracter-type call, or moving quietly against the bark of a tree or through the woods is difficult with garments made in traditional three dimensional garment construction techniques.

New advances in three-dimensional camouflage garment concepts have resulted in garments that attempt to alleviate these problems through garment construction techniques that utilize flat fabrics in key panels or positions within the garment. U.S. Pat. No. 5,695,835 to Weber et al. illustrates a multi-dimensional camouflage garment that has an external surface, a first portion of the external surface being formed of a three dimensional material and a second portion of the external surface being formed of a two dimensional material. Other garments formed from three dimensional materials are shown in U.S. Pat. No. 4,656,065 to Yacovella, U.S. Pat. No. 5,773,101 to Sanders, and U.S. Pat. No. 5,445,863 to Slagle.

While these garments types alleviate at least some of the problems mentioned previously, they vacate the original purpose of the three-dimensional concept and therefore fall short of giving the user the full three-dimensional camouflage effect.

SUMMARY OF THE INVENTION

Accordingly, it is an object of the present invention to provide a three-dimensional camouflage garment that avoids the problems mentioned previously.

It is a further object of the present invention to provide a three-dimensional camouflage garment which gives the user a full three-dimensional effect.

The foregoing objects are achieved by the camouflage garment of the present invention.

In accordance with the present invention, a camouflage garment is provided which utilizes different heights of three-dimensional materials in strategic panels or points to alleviate the problems mentioned above while still giving the user the full benefit of an all-inclusive three-dimensional camouflage fabric garment. The camouflage garment broadly comprises a first portion formed from a first three dimensional material having a first texture height and a second portion formed a second three dimensional material having a second texture height different from the first texture height. The camouflage garment may be a jacket, a pair of pants, or any other type of camouflage garment.

Other details of the camouflage garment of the present invention, as well as other objects and advantages attendant thereto, are set forth in the following description and the accompanying drawings wherein like reference numerals depict like elements.

DETAILED DESCRIPTION OF THE PREFERRED EMBODIMENT(S)

Figure 1:
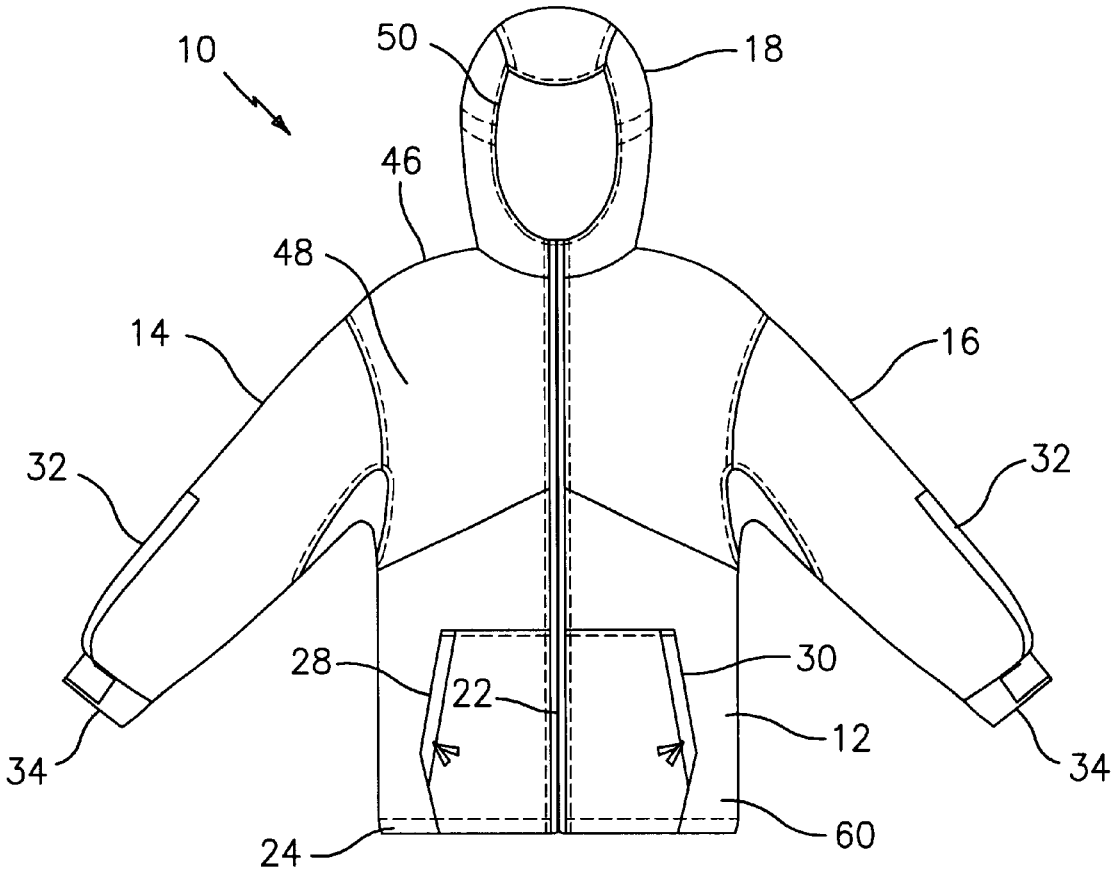
FIG. 1 illustrates a front view of a three dimensional camouflage garment in accordance with the present invention.

Referring now to FIG. 1, a multi-dimensional camouflage garment 10 is illustrated is in the form of a jacket or parka. The garment 10 has a torso 12, a right arm 14, a left arm 16, and a hood 18.

The garment 10 has a front opening 20 and a zipper closure 22. It should be understood that if desired the zipper closure 22 can be replaced by snap closures, button closures, or closures formed from hook and pile fabrics.

Figure 2:
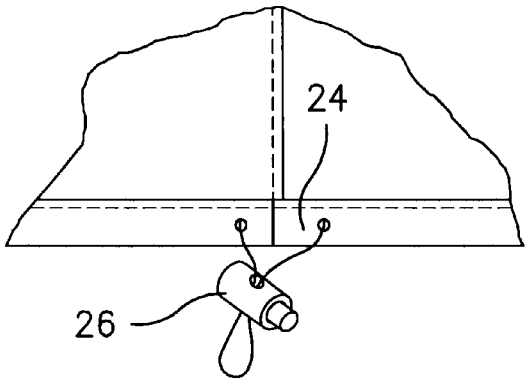
FIG. 2 illustrates a drawcord arrangement provided on each side of the garment.
Figure 3:
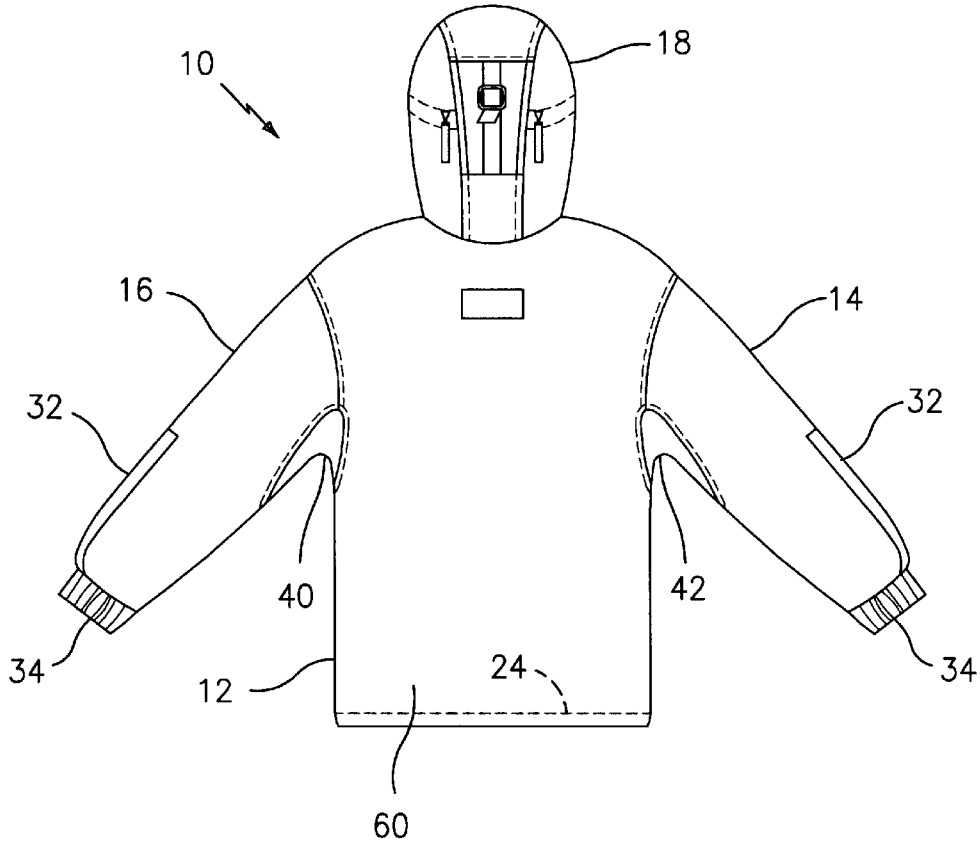
FIG. 3 is a rear view of the garment of FIG. 1.

The garment 10 may be provided with a drawcord 24 along the bottom of the garment. As shown in FIG. 2, the drawcord may have tie members 26 along the right and left sides of the garments to allow the drawcord to be adjusted to the user.

The garment 10 also is provided with pockets 28 and 30 along the front of the garment. The pockets 28 and 30 may each be open pockets or closed pockets. If the latter, suitable means such as snaps, buttons, and the like may be provided to hold the pockets 28 and 30 closed.

Each of the arms 14 and 16 is preferably provided with a welted zipper 32 with gussets as shown in dotted lines in FIG. 1. The end of each arm may have sleeves 34 with elastic therein to hold the sleeves close to the user's wrist. In lieu of elastic, each of the sleeves 34 may be adjustable via pieces of hook and pile fabric.

Figure 4:
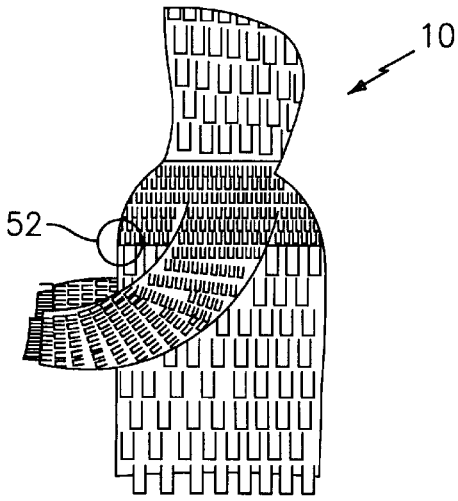
FIG. 4 is a side view of the garment of FIG. 1 showing fabrics having different texture heights.
Figure 5:
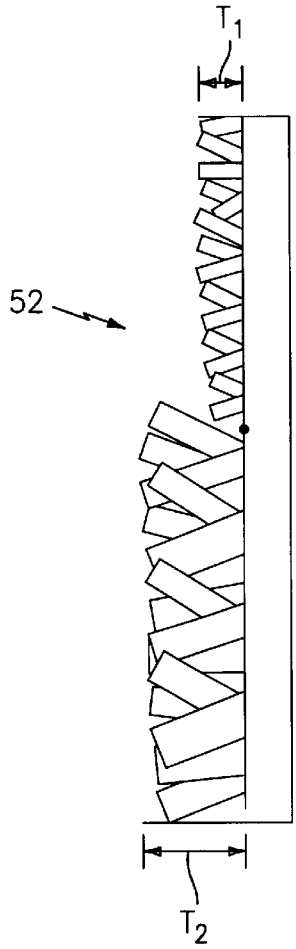
FIG. 5 is an enlarged view of a portion of the garment of FIG. 4.
Figure 6:
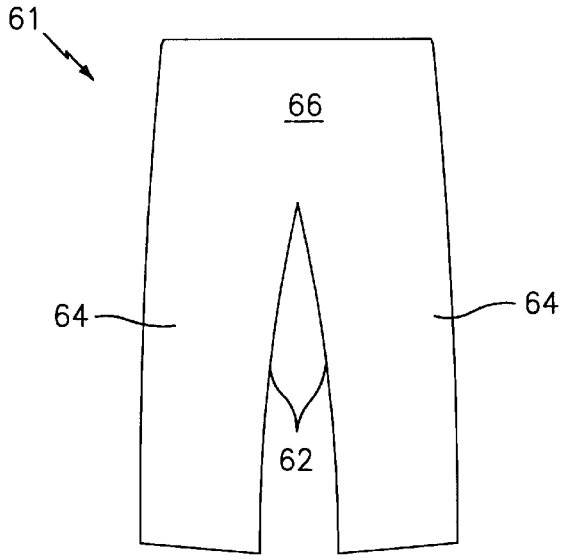
FIG. 6 is a rear view of a pair of camouflage pants.

As shown in FIGS. 4 and 5, the garment 10 of the present invention is advantageously formed from two different three dimensional materials. Typically, a three dimensional material has a texture height which may be defined as the height from a low point on an outer surface of the material to a high point on an outer surface of the material. In accordance with the present invention, various portions of the garment 10 where hindrances occur or may occur are formed from a first three dimensional material having a first texture height $T_1$ which helps eliminate the hindrances, while other portions of the garment which are not subject to the hindrances are formed from a second three dimensional material having a second texture height $T_2$ different from the first texture height. This is shown in FIGS. 4 and 5 where an enlarged portion of the garment 10 is illustrated.

In the garment 10, portions such as the inside areas 40 and 42 of the arms 14 and 16, one or both of the shoulders 44 and 46, one or both panels in the chest region 48, and/or the face 50 of the hood can be formed from a first three-dimensional material having a first texture height $T_1$ which is sufficient to alleviate the unwanted hindrances. For example, these portions could be formed from a three dimensional material having a texture height of one inch. Other portions of the garment, such as a lower portion 60 of the torso 12, where there are no hindrances to be alleviated, may be formed from a second three dimensional material having a second texture height $T_2$ different from the texture height of the first three dimensional material. For example, the non-hindranced portions could be formed from a three dimensional fabric having a three inch texture height.

While the camouflage garment has been illustrated herein as being in the form of a jacket or parka, the camouflage garment could be a coat, a poncho style garment, a vest, a shirt, coveralls, bib overalls, and rain apparel.

The technology described herein may also be used to form camouflaged pants 61 having a first three dimensional material of appropriate hindrance avoiding texture height on such portions as an inside portion 62 of each leg 64, the seat 66 of the pants, and any other place where high-loft three-dimensional fabrics would promote problems in hunting situations. The remaining portions of the pants 60 would then be formed from a second three dimensional material having a second texture height different from the texture height of the first three-dimensional material.

If desired, the three-dimensional fabrics used to fabricate the garments of the present invention may have a liner attached to an inner surfaces to provide warmth and protection from moisture. Additionally, the three-dimensional fabrics used to fabricate the garments may be treated to be water-repellent.

It is apparent that there has been provided in accordance with the present invention a three dimensional camouflage garment which fully satisfies the objects, means, and advantages set forth hereinbefore. While the present invention has been described in the context of specific embodiments thereof, other variations, modifications, and alternatives will become apparent to those skilled in the art having read the foregoing description. Accordingly, it is intended to cover such variations, modifications, and alternatives as fall within the broad scope of the appended claims.

What is claimed is:

1. A camouflage garment comprising:

at least one first portion formed from a first three dimensional material having a first height from a lowest point on an outer surface of said first three dimensional material to a high point on said outer surface of said first three dimensional material; and at least one second portion formed from a second three dimensional material having a second height from a lowest point on an outer surface of said second three dimensional material to a high point on said outer surface of said second three dimensional material, said second height being different from said first height.

2. A garment according to claim 1, wherein said first height is sufficient to avoid unwanted hindrances to a wearer of the garment.

3. A garment according to claim 1, wherein said second height is greater than said first height.

4. A garment according to claim 1, wherein said garment has two arms and wherein inside areas of said arms are formed from said first three dimensional material.

5. A garment according to claim 1, wherein said garment has a pair of shoulder portions and at least one of said shoulder portions is formed from said first three dimensional material.

6. A garment according to claim 1, wherein said garment has a chest region formed from a plurality of panels and wherein at least one of said panels is formed from said first three dimensional material.

7. A garment according to claim 1, wherein said garment has a hood and at least a portion of said hood is formed from said first three dimensional material.

8. A garment according to claim 1, wherein said garment has a torso and at least a lower portion of said torso is formed from said second three dimensional material.

9. A garment according to claim 1, wherein said garment comprises a jacket having a torso, a pair of arms, a front opening, means for closing said front opening, and at least one pocket.

10. A garment according to claim 9, wherein said jacket further comprises a draw cord along a lower portion of said torso.

11. A garment according to claim 9, wherein each of said arms is provided with a waited zipper.

12. A garment according to claim 1, wherein said garment is a pair of pants.

13. A garment according to claim 12, wherein said pants has a pair of legs and wherein an inside portion of each said leg is formed from said first three dimensional material.

14. A garment according to claim 12, wherein said pants has a seat and said seat is formed from said first three dimensional material.

15. A garment according to claim 1, wherein all outer portions of said garment are formed only from said first and second three dimensional materials.

16. A camouflage garment having an external surface, said external surface having at least one first portion formed from a first three dimensional material having a first height from a lowest point on an outer surface of said first material to a high point on said outer surface of said first material and at least one second portion formed from a second three dimensional material having a second height from a lowest point on an outer surface of said second material to a high point on said outer surface of said second material, said second height being different from said first height.

* * * * *